US005349783A

United States Patent [19]

Jasperson et al.

[11] Patent Number: 5,349,783

[45] Date of Patent: Sep. 27, 1994

[54] TWIN WHEEL GUIDE FOR SLIDING DOORS

[75] Inventors: Steve J. Jasperson, Fort Wayne, Ind.; Torsti T. T. Jerila, West Covina, Calif.

[73] Assignee: The Stanley Works, New Britain, Conn.

[21] Appl. No.: 23,603

[22] Filed: Feb. 26, 1993

[51] Int. Cl.[5] ..... E05D 15/06

[52] U.S. Cl. ..... 49/425; 16/91; 16/105; 49/404

[58] Field of Search ..... 49/425, 404, 410, 411; 16/91, 97, 102, 105, 106, 107

[56] References Cited

U.S. PATENT DOCUMENTS

| | | | |
|---|---|---|---|
| 1,983,959 | 12/1934 | Wuebling . | |
| 2,724,867 | 11/1955 | Smith | 16/97 X |
| 3,058,173 | 10/1962 | Brydolf | 16/105 X |
| 3,167,112 | 1/1965 | Tucker . | |
| 3,241,197 | 3/1966 | Gogerty . | |
| 3,750,337 | 8/1973 | Brydolf et al. | 49/411 |
| 4,193,500 | 3/1980 | Scott | 49/425 X |
| 4,262,451 | 4/1981 | Dallaire . | |
| 4,478,006 | 10/1984 | Johnson, Jr. | 16/105 X |
| 4,653,127 | 3/1987 | Baus . | |
| 4,722,150 | 2/1988 | Jacobs et al. . | |
| 5,069,512 | 12/1991 | Sykes | 49/425 X |

*Primary Examiner*—Philip C. Kannan

[57] ABSTRACT

A support assembly for a sliding door includes an elongated track providing a track portion of generally inverted U-shaped cross section with spaced vertical walls. A wheeled guide rides in this track portion and includes a mounting member and a body member of generally inverted L-shaped configuration. The vertical leg is secured to a door and extends upwardly therefrom; and the horizontal leg extends horizontally above the door. A pair of wheels is rotatably mounted on the horizontal leg for rotation about axes perpendicular to the horizontal leg and their peripheral portions extend beyond the opposite ends of the horizontal portion. The axes of the wheels are oriented on an imaginary line extending at an angle of at least 30° to the central axis of the horizontal leg, and the circumferential portions of the wheels rotatably bear on the vertical walls of the track.

21 Claims, 5 Drawing Sheets

48
46
53
56
56
57
34
54
12
14
24
28
30
62
60
21
36
23
20
20
40
26
42
21
18

FIG. 6
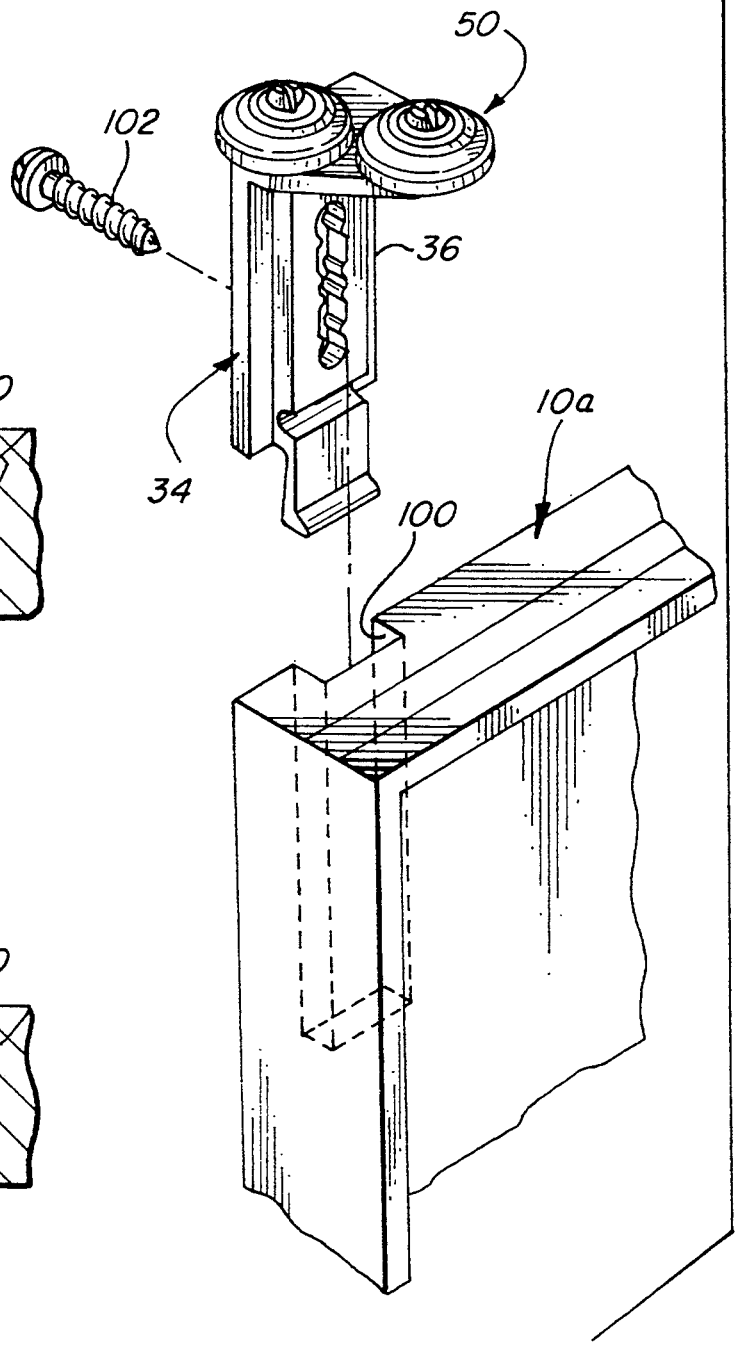
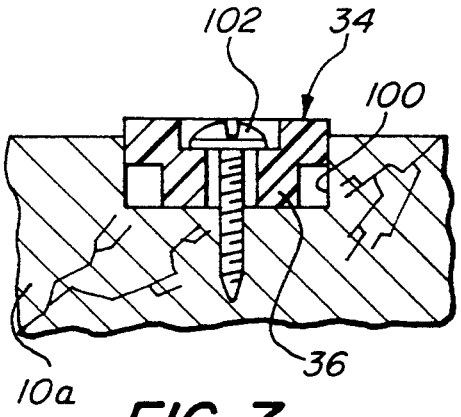
FIG. 7
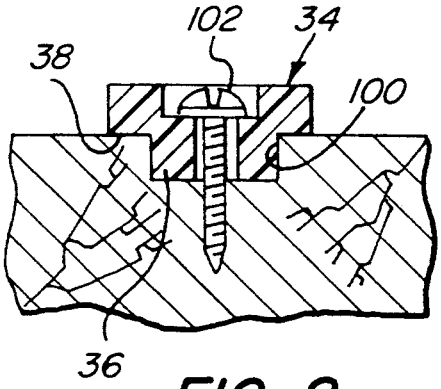
FIG. 8

TWIN WHEEL GUIDE FOR SLIDING DOORS

BACKGROUND OF THE INVENTION

The present invention relates to sliding doors and, more particularly, to a novel guide assembly for the upper end of a sliding door.

Sliding doors are utilized in a wide variety of applications, and frequently as closet closures. Although some sliding doors will slide into a pocket within the wall, it is more common to close an opening with a pair of bypassing doors which are guided in upper tracks and stabilized at their lower ends in tracks or guides. When the door is one which includes a mirror, frequently the mirror itself is encased in a metal or wooden frame with guides being provided at the upper end of the frame to seat in the track for stabilization of the door.

In Jacobs et al U.S. Pat. No. 4,722,150 granted Feb. 2, 1988, there is disclosed a door guide for the upper end of a mirrored door which, in one embodiment, includes a pair of roller elements adapted to bear against opposite faces of a U-shaped channel. As will be appreciated, the diameter of these rotating elements must be such that the pair of elements will fit within the width of the track, and this track is normally of a relatively small width so that the diameters of the individual rotating elements is relatively small. Because of the weight of the door and the resultant friction as the door rolls back and forth along the track, the rotating elements do wear, and, as they wear, their efficiency in stabilizing the upper end of the door is decreased.

Moreover, the rolled metal tracks which are frequently utilized are subject to a fairly large tolerances in the fabrication of the width of the channels and frequently these tracks are distorted, either during installation or as the result of shock loadings which might be placed on the tracks through the door. This also results in a tendency for increasing wear and for decreasing the stability and smooth operation of the movement of the door in the track.

It is an object of the present invention to provide a novel door guide assembly which will exhibit long life while providing smooth motion of the upper portions of the door along a track.

It is also an object to provide such a door guide assembly which is relatively simple and economical to fabricate and which may be readily installed upon the door.

Another object is to provide such a door guide assembly which affords smooth operating characteristics despite defects in the track within which the door guide rides.

SUMMARY OF THE INVENTION

It has now been found that the foregoing and related objects may be readily attained in a support assembly for a sliding door comprising an elongated track providing a track portion of generally inverted U-shaped cross section having a pair of vertical walls. A wheeled guide is adapted to be secured to a door and to extend upwardly therefrom, and it includes (i) a body member of generally inverted L-shaped configuration defined by a vertical leg for mounting to the door and a horizontal leg extending horizontally above the body member and over the associated door; and (ii) a pair of wheels rotatably mounted on the horizontal leg for rotation about axes perpendicular to the horizontal leg. The peripheral portions of the wheels extend beyond the opposite ends of the horizontal portion, and the axes of the wheels are oriented on an imaginary line extending at an angle of at least 30° to the central axis of the horizontal leg. The circumferential portions of the wheels rotatably bear on the walls of the track.

In some embodiments, the wheeled guide includes a mounting member which is adapted to be secured to the door, and the vertical leg of the body member is secured to it. Preferably, the mounting member is elongated and the vertical leg of the body member is adjustably secured to the mounting member to vary the spacing of the horizontal leg of the body member above the mounting member. The mounting member is desirably configured to provide an elongated vertical channel in which the vertical leg of the body member is slidable, and a fastener is secured to the mounting member and extends through an elongated slot in the vertical leg. Desirably, the side walls of this slot are configured to provide a series of detents in which the fastener may seat to effect such adjustment. The vertical leg of the body member also has a depending tail at its lower end which is configured to resiliently bear against the mounting member and bias the upper end of the vertical leg towards the mounting member.

The body member is preferably integrally formed of synthetic resin, and the horizontal leg of the body member has a pair of upstanding posts thereon about which the wheels rotate. The posts may have a collar about the lower end thereof to provide a bearing surface for the wheels.

Desirably, the wheels include a hub and an annular tire of resiliently deformable synthetic resin extending about the hub. Preferably, the lower portion of the hub has a smaller diameter neck to provide a bearing surface.

Frequently, the track has a generally E-shaped cross section providing two U-shaped track portions defined by pairs of vertical outer walls and a common center wall. In this manner, a pair of doors may be mounted to provide a bypassing assembly.

BRIEF DESCRIPTION OF THE DRAWINGS

FIG. 6 is a partially exploded view of one embodiment of the guide assembly to be assembled upon a fragmentarily illustrated door utilizing a wood frame;

FIG. 7 is a sectional view of the assembled parts; and

FIG. 8 is a similar view showing an alternate mounting of the guide assembly.

DETAILED DESCRIPTION OF THE PREFERRED EMBODIMENT

Figure 1:
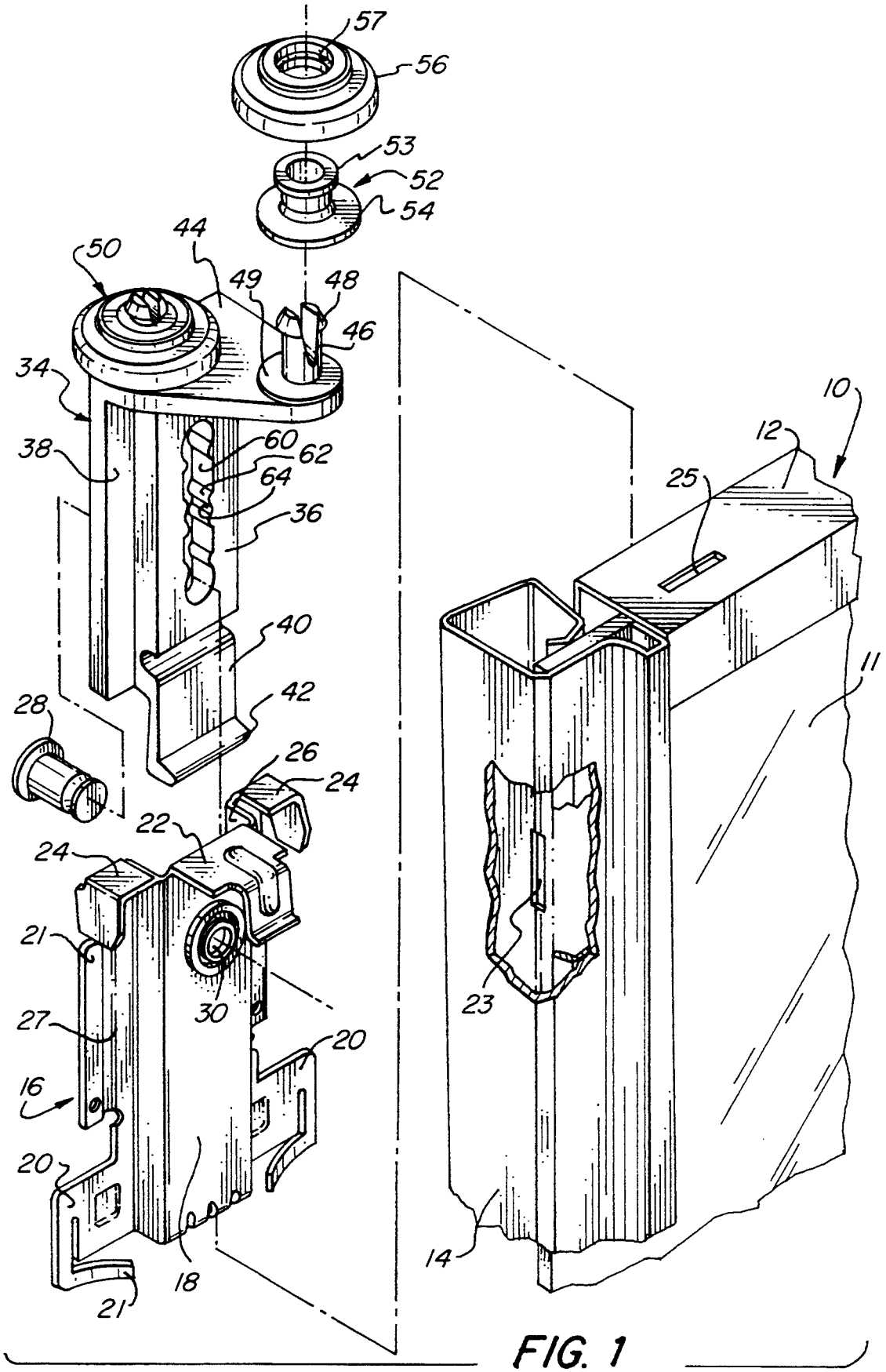
FIG. 1 is a partially exploded view of a guide assembly embodying the present invention and a fragmentarily illustrated mirrored door upon which it is to be mounted.
Figure 2:
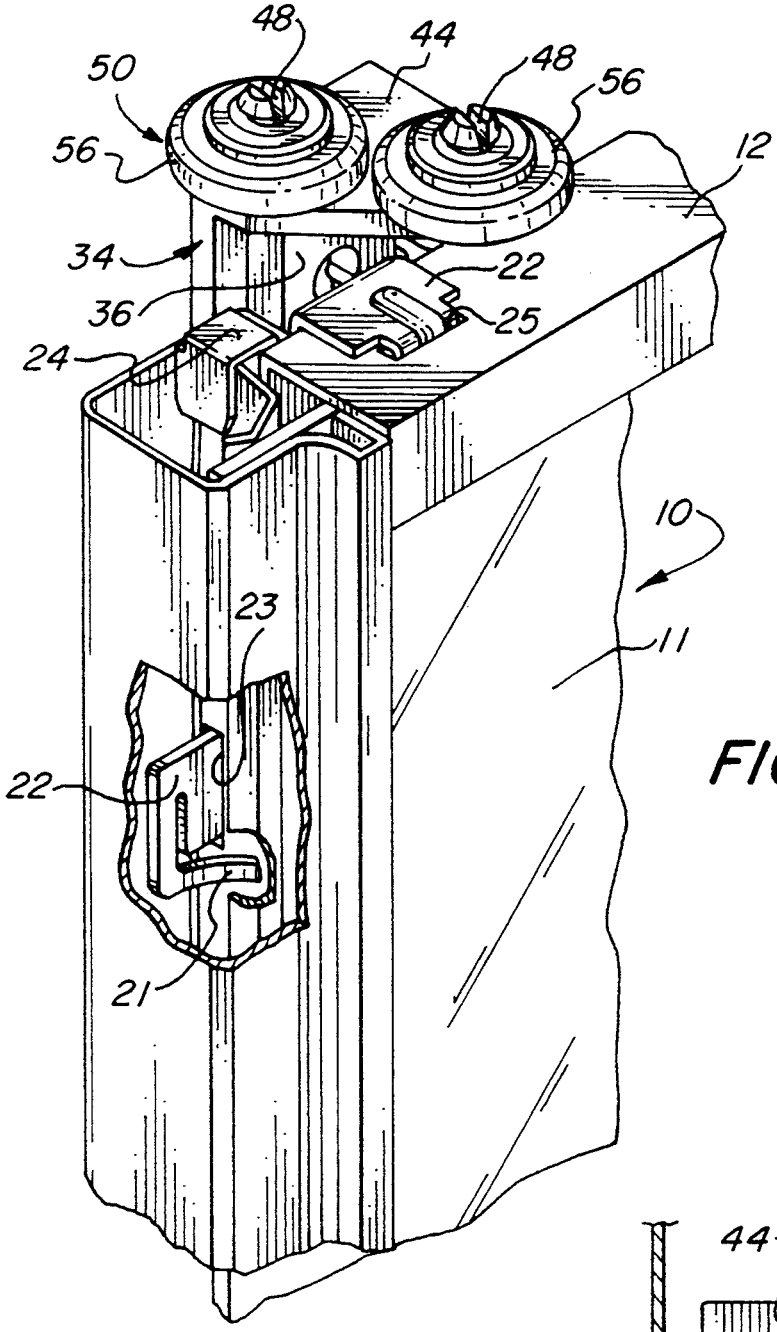
FIG. 2 is a fragmentary perspective view of the assembly of the door and guide of FIG. 1.

Turning first to FIGS. 1 and 2, a mirrored door generally designated by the numeral 10 conventionally comprises a mirror 11 which is seated in a frame. In this instance the frame includes a hollow top rail 12, hollow stiles 14, and a bottom rail (not shown). Engaged with the top rail 12 and stiles 14 at the abutting ends are mounting members generally designated by the numeral 16 (only one of which is shown). The mounting member 16 has an elongated body 18 extending vertically along one side of the door 10 with flanges 20 extending outwardly at its lower end and provided with curvilinear fingers 21.

As seen in FIG. 2, the flange 20 extends through a slot 23 in the stile 14 with the finger 21 deflecting during insertion and thereafter locking the flange 20 in the stile 14. At its upper end, the mounting member 16 has a pair of inverted U-shaped mounting flanges 24 extending to either side thereof, one of which engages over the wall of the stile 14. The upper end also has a centrally disposed, inverted U-shaped flange 22 which has its downward leg extending into the slot 25 of the top rail 12. The body 18 of the mounting member 16 is of U-shaped cross section to provide a vertically extending channel 26 with an aperture 30 extending therethrough, and extending from the sides thereof are the central flanges 27, one of which have offset portions 21 which will bear against the outer surface of the stile 14.

Slidably seated on the mounting member 16 is the body member generally designated by the numeral 34 and having a generally inverted L-shaped configuration with a vertical leg 36 slidably seating in the channel 26 and having flanges 38 extending along its sides slidable against the planar face of the flanges 27 and 24. Depending from the vertical leg 36 is an inclined tail piece 40 with a boss 42 at its lower end which is configured to bear resiliently against the mounting member 16 and bias the upper end of the vertical leg 36 towards the mounting member 16 to stabilize the body member 34 in the mounting member 16. Centrally of the vertical leg 36 is an elongated slot 60 with side surfaces having opposed ribs 62 defining detents 64 which seat the shank of the fastener or shouldered rivet 28 which extends therethrough and is seated in the aperture 30. This permits slidable adjustment of the vertical leg 36 in the channel 26 of the mounting member 16.

As seen, the body member 34 has a horizontal leg 44 at its upper end which is of generally right triangular configuration tapering to a reduced width at its outer or free end. A pair of posts 46 extend upwardly therefrom at the opposite ends thereof, and the posts 46 have a collar 49 about their base and bosses 48 about their bifurcated upper ends.

Rotatably mounted on the posts 46 are the guide wheels generally designated by the numeral 50 and comprising a hub generally designated by the numeral 52 and an annular element or tire 56 disposed thereabout. The hub 52 has a small diameter flange or collar 53 at its upper end and a large diameter flange or collar 54 adjacent its lower end.

Figure 4:
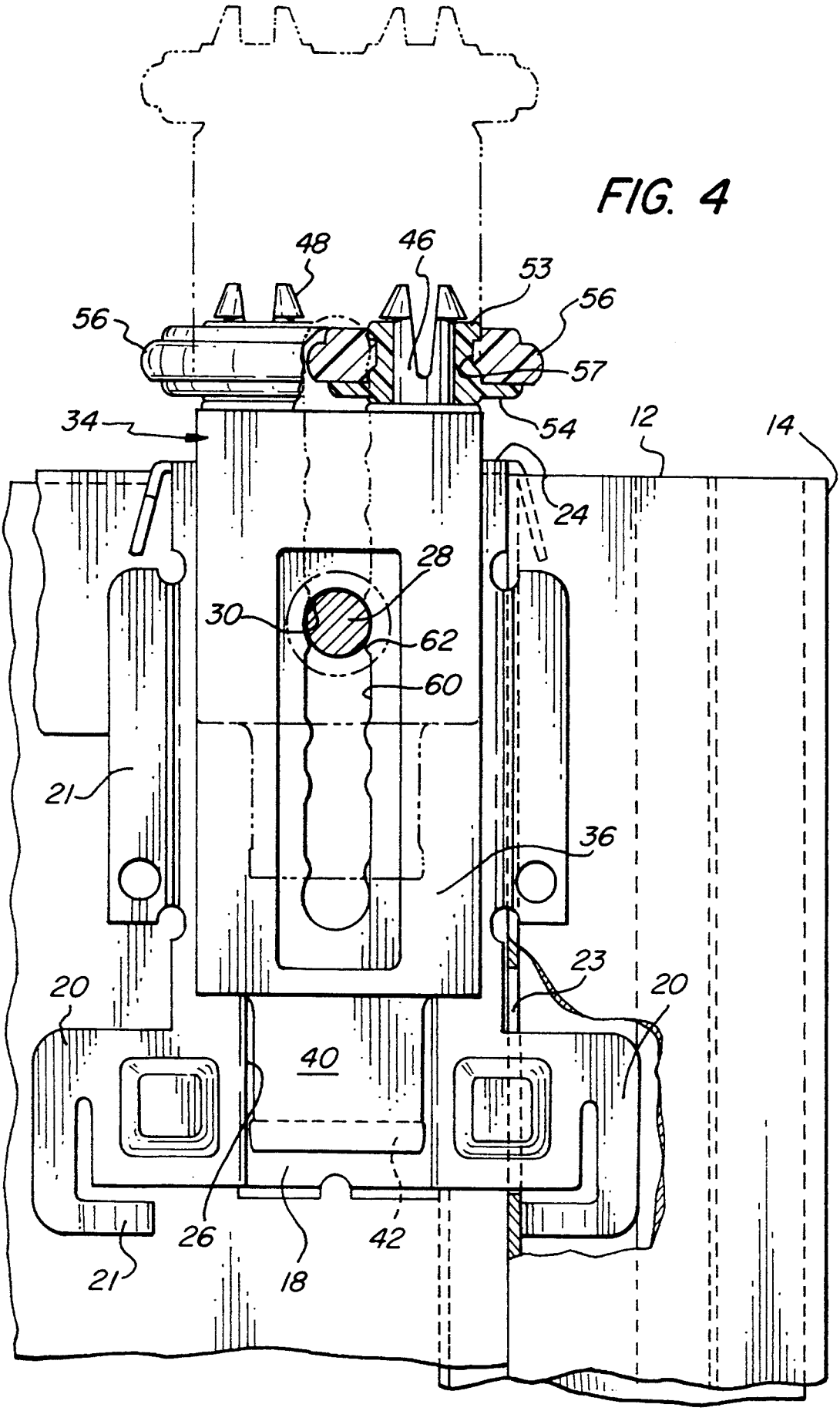
FIG. 4 is a fragmentary front elevational view of the assembled door and guide to an enlarged scale illustrating in phantom line the vertical adjustability of the height of the wheels above the door.

As seen in FIG. 4, the tires 56 have a rib 57 about their inner periphery which seats within the axial spacing between the flanges 53, 54, and they are dimensioned so that their outer circumferences project outwardly of the flanges 54.

Figure 3:
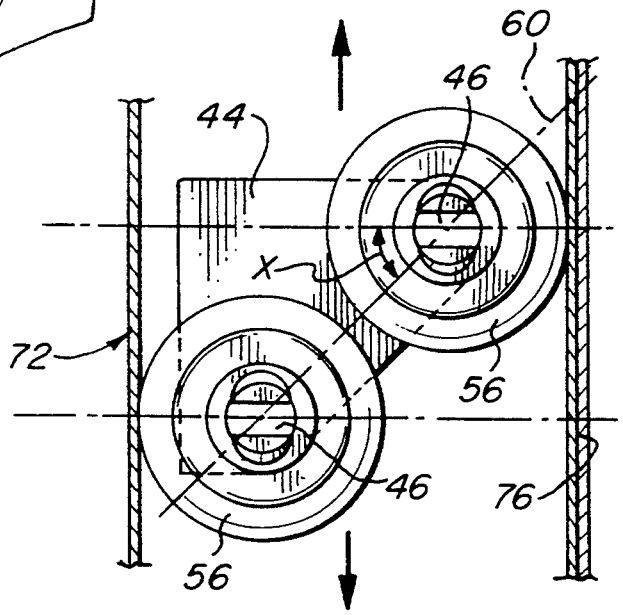
FIG. 3 is a fragmentary plan view of the guide assembly of FIG. 2 within a track fragmentarily illustrated in section.

As best seen in FIG. 3, the axes of the posts 46 are located on an imaginary line 60 which is at an angle x of about 45° to the plane of the vertical leg 36 and, as previously indicated, are adjacent the ends of the horizontal leg 44 so that the circumferential portions of the wheels 56 project therebeyond.

Figure 5:
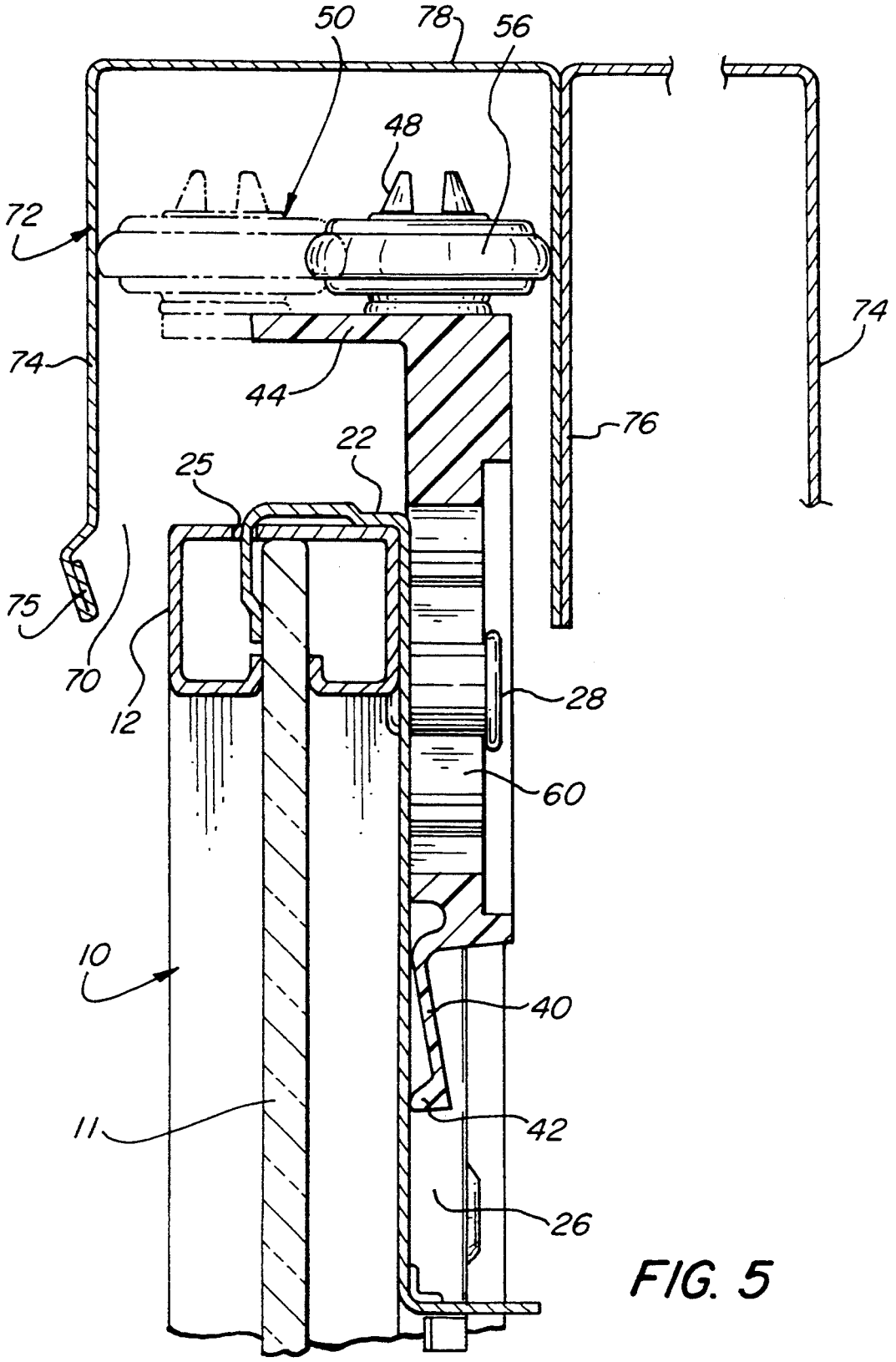
FIG. 5 is a fragmentary sectional view of the door I assembly within a fragmentarily illustrated track.

As seen in FIG. 5, the guide assembly on the top of the door 10 projects into the inverted U-shaped track channel 70 of the track member generally designated by the numeral 72. Conveniently, the track member 72 is formed in a generally E-shaped cross section with a pair of outer vertical walls 74, a central vertical wall 76 and a horizontal upper wall 78. In the illustrated embodiment, the outer vertical walls 74 of the sheet metal structure have reversely bent lower end portion 75 to provide a rolled over lower edge. As can be seen, the wheels 50 bear against the outer wall 74 and central vertical wall 76, and the dimensioning of the several elements is intended to provide a small amount of resilient compression of the tires 56 to ensure good guiding action for the upper end of the door 10 without producing excessive frictional resistance to smooth rolling action.

Turning now to FIGS. 6–8 therein, illustrated are alternative embodiments of an installation in which the body member 34 is mounted directly to a wooden door frame 8 rather than being secured to the door through the use of a mounting member. As can be seen in FIG. 7, the door **10*a* is provided with a vertically extending channel 100 dimensioned to slidably seat the vertical leg 36 including its side flanges 38. The body member 34 is secured by the screw 102 which extends through the slot 60** as in the earlier embodiment.

As seen in FIG. 8, the channel **100*a* is narrower and seats only the major portion of the vertical leg 36 and the side flanges 38 are slidably disposed against the outer surface of the door 10*a*. In both forms of mounting, the depending tail piece 40 bears against the base surface of the channel 100 to bias the upper end of the body member 34 towards the door 10*a* and about the pivot point provided by the fastener 102 which extends through the slot 60**.

As will be readily appreciated, in the present invention the axes of rotation of the guide wheels 50 are disposed at a substantial angle to the vertical walls of the channel, which in the illustrated embodiment, is approximately 41°. However, the angle may vary from 30 to 60° depending upon the desired spacing between the axis. It will be appreciated that the width of the horizontal leg 44 required for larger angles may require increasing the width of the vertical leg 36 or having the horizontal leg extend beyond the edge margins of the vertical leg 36.

This angular orientation permits a substantial increase in the spacing between the axes for a given channel width and thereby permits the use of guide wheels of substantially larger diameter than would be possible if they were oriented on a perpendicular line. The larger diameter wheels 50 facilitate smoother rolling along the vertical walls 74 of the track 72 and provide improved wear characteristics because of the larger circumference provided on the wheels. In addition, the angular orientation of the wheels at the two ends of the door 10 improves the stability of the orientation of the door 10 with respect to the track 72.

It will also be appreciated that the angular relationship of the axes of rotation of the wheels 50 also provides for torsional flexibility in the guide assembly. This torsional flexibility combined with the resiliently deformable material from which the tires are manufactured substantially assures that the wheels of the guide will stay in constant contact with the vertical walls of the channel since they are able to compensate for variations in distance between the vertical walls which may occur as a result of allowable manufacturing deviation or from damage as a result of installation or use.

In the illustrated embodiment, the combination of the rivet 28 and detended slot 60 allows facile adjustment of the vertical positioning of the vertical leg 36 and thereby the wheels above the door and within the track. As is conventional with sliding doors, the weight of the door is actually carried by the guide elements at the lower end of the door, and thus the frictional retention of the fastener 28 within the detents 64 is sufficient to provide a stable positioning of the guide wheels 50 since the weight of the door 10 is not carried thereby. This permits compensation for variations in the finished opening height of the frame within which the door will be located.

Another advantage of the illustrated construction is that the guide wheels can be fabricated very conveniently and economically as two separate elements, the hub and the tire. The configuration of the hub and the tire allows the two elements to be readily assembled by flexing the tire over the upper flange, and the elements will be securely retained in assembly thereafter.

As will be readily appreciated, the mounting member may be conveniently formed from a single piece of sheet metal in stamping operations. However, it may also be molded from synthetic resin if so desired. The track may comprise an extrusion and the rails and stiles for the frame of the door may also be extrusions.

The body member is integrally formed from suitable synthetic resins such as the polyacetals and polyamides which have long life as well as the desired degree of resilience. The same is true with respect to the molding of the hubs for the wheels. The tires are conveniently fabricated from resiliently deformable synthetic resins such as butadiene styrene polymers, polyurethanes, polyisoprenes and the large family of resins known as thermoplastic elastomers.

As indicated in the attached drawings, the body member carrying the wheels can be affixed directly to the door or through the separate mounting member in the case of metal framed doors or other relatively complex structures. The fastener shown in the first embodiment may be a rivet as illustrated, or it may be a threaded fastener.

Although the guide assembly has been shown in connection with a mirrored door, it is also applicable to broad panel other doors.

Thus, it can be seen from the foregoing detailed specification and attached drawings that the door guide assembly of the present invention provides relatively large diameter guide wheels to resiliently bear against the vertical walls of the track in which they are disposed and thereby provide smooth motion for the upper portion of the door therealong. The assembly may be fabricated from relatively economical components and it may be readily installed upon the frame for the door. Not only will the assembly provide the desired smooth operation wear and resistance, but also it will accommodate minor variations in the spacing between the walls of the channel.

Having thus described the invention, what is claimed is:

1. A support assembly for a sliding door comprising:

(a) an elongated track providing a track portion of generally inverted U-shaped cross section with a pair of vertical walls; and (b) a wheeled guide comprising (i) a body member of generally inverted L-shaped configuration defined by a vertical leg adapted to be mounted to the door and a horizontal leg extending horizontally above said vertical leg and adapted to extend over the associated door; and (ii) a pair of wheels rotatably mounted on said horizontal leg for rotation about axes perpendicular to said horizontal leg and having their peripheral portions extending beyond the opposite ends of said horizontal portion, the axes of rotation of said wheels being oriented on an imaginary line extending at an angle of at least 30° to the central axis of said horizontal leg, the circumferential portions of said wheels rotatably bearing on said vertical walls of said track.

2. The sliding door support assembly in accordance with claim 1 wherein said wheeled guide includes a mounting member adapted to be secured to the associated door and wherein said vertical leg of said body member is secured to said mounting member.

3. The sliding door support assembly in accordance with claim 2 wherein said mounting member is elongated and wherein said vertical leg of said body member is adjustably secured to said mounting member to vary the spacing of said horizontal leg of said body member above said mounting member.

4. The sliding door support assembly in accordance with claim 3 wherein said mounting member is configured to provide an elongated vertical channel in which said vertical leg of said body member is slidable.

5. The sliding door support assembly in accordance with claim 4 wherein said vertical leg of said body member has a depending tail at its end opposite said horizontal leg, said tail being configured to resiliently bear against said mounting member and bias the other end of said vertical leg towards said mounting member.

6. The sliding door support assembly in accordance with claim 4 wherein a fastener is secured to said mounting member extends through an elongated slot in said vertical leg.

7. The sliding door support assembly in accordance with claim 6 wherein said slot has side walls configured to provide a series of detents in which said fastener may seat to effect such adjustment.

8. The sliding door support assembly in accordance with claim 1 wherein said body member is integrally formed of synthetic resin.

9. The sliding door support assembly in accordance with claim 8 wherein said horizontal leg of said body member has a pair of upstanding posts thereon about which said wheels rotate.

10. The sliding door support assembly in accordance with claim 9 wherein said posts have a collar about the lower end thereof to provide a bearing surface for said wheels.

11. The sliding door support assembly in accordance with claim 1 wherein said horizontal leg of said body member has a pair of upstanding posts thereon about which said wheels rotate and said posts have a collar about the lower end thereof to provide a bearing surface upon which said wheels rotate, said body member being integrally formed of synthetic resin, and wherein said wheels have a resiliently deformable circumferential portion.

12. The sliding door support assembly in accordance with claim 1 wherein said wheels include a hub and an annular tire of resiliently deformable synthetic resin extending about said hub.

13. The sliding door support assembly in accordance with claim 12 wherein the lower portion of said hub includes a neck of smaller diameter providing a bearing surface.

14. The sliding door support assembly in accordance with claim 1 wherein said track has a generally E-shaped cross section providing two inverted U-shaped track portions defined by pairs of vertical outer walls and a common center wall.

15. In a sliding door installation, the combination comprising:

(a) a door;

(b) an elongated track above said door providing a track portion of generally inverted U-shaped cross section with a pair of vertical walls; and (c) a wheeled guide comprising (i) a body member of generally inverted L-shaped configuration defined by a vertical leg secured to said door and a horizontal leg extending horizontally above said door; and (ii) a pair of wheels rotatably mounted on said horizontal leg for rotation about axes perpendicular to said horizontal leg and having their peripheral portions extending beyond the opposite ends of said horizontal portion, the axes of rotation of said wheels being oriented on an imaginary line extending at an angle of at least 30° to the central axis of said horizontal leg, the circumferential portion of said wheels rotatably bearing on said vertical walls of said track.

16. The sliding door installation in accordance with claim 15 wherein said wheeled guide includes a mounting member secured to said door and wherein said vertical leg of said body member is secured to said mounting member.

17. The sliding door installation in accordance with claim 16 wherein said mounting member is elongated and wherein said vertical leg of said body member is adjustably secured to said mounting member to vary the spacing of said horizontal leg of said body member above said mounting member, said mounting member being configured to provide an elongated vertical channel in which said vertical leg of said body member is slidable.

18. The sliding door installation in accordance with claim 17 wherein a fastener is secured to said mounting member and extends through an elongated slot in said vertical leg, the side walls of said slot being configured to provide a series of detents in which said fastener may seat to effect adjustment.

19. The sliding door installation in accordance with claim 18 wherein said vertical leg of said body member has a depending tail at its end opposite said horizontal leg, said tail being configured to resiliently bear against said mounting member and to bias the other end of said vertical leg towards said mounting member.

20. The sliding door installation in accordance with claim 15 wherein said body member is integrally formed of synthetic resin and said horizontal leg of said body member has a pair of upstanding posts thereon about which said wheels rotate.

21. The sliding door installation in accordance with claim 15 wherein aid wheels include a hub and an annular tire of resiliently deformable synthetic resin extending about said hub, and the lower portion of said hub includes a neck of smaller diameter providing a bearing surface.

* * * * *